US006671486B1

(12) United States Patent
Fletcher

(10) Patent No.: US 6,671,486 B1
(45) Date of Patent: Dec. 30, 2003

(54) COMMON POLARITY TONER DUPLEXING ELECTROSTATOGRAPHIC REPRODUCTION MACHINE

(75) Inventor: Gerald M. Fletcher, Pittsford, NY (US)

(73) Assignee: Xerox Corporation, Stamford, CT (US)

( * ) Notice: Subject to any disclaimer, the term of this patent is extended or adjusted under 35 U.S.C. 154(b) by 50 days.

(21) Appl. No.: 10/164,978

(22) Filed: Jun. 6, 2002

(51) Int. Cl.[7] ..... G03G 15/22
(52) U.S. Cl. ..... 399/306; 399/296
(58) Field of Search ..... 399/296, 299, 399/306, 309, 127, 128, 129, 364; 355/24

(56) References Cited

U.S. PATENT DOCUMENTS 3,580,670 A * 5/1971 Bhagat ..... 399/306
4,958,187 A * 9/1990 Tsuchiya et al. ..... 399/306
5,848,323 A * 12/1998 Umeda et al. ..... 399/66
6,144,836 A * 11/2000 Umeda et al. ..... 399/400
6,253,054 B1 * 6/2001 Maess et al. ..... 399/302
6,336,023 B1 * 1/2002 Toyama et al. ..... 399/296
6,556,804 B1 * 4/2003 Lobel et al. ..... 399/306

FOREIGN PATENT DOCUMENTS

EP 0 629 924 B1 10/1997

* cited by examiner

*Primary Examiner*—Robert Beatty
(74) *Attorney, Agent, or Firm*—Tallam I. Nguti

(57) ABSTRACT

A common polarity duplexing electrostatographic reproduction machine is provided and includes (i) a first plurality of toner image producing electrostatographic modules that each include a first image forming surface, image forming devices, and charged toner particles having a first polarity, (ii) a second plurality of toner image producing electrostatographic modules that each have a second image forming surface, image forming devices, including charged toner particles having a polarity common with the first polarity, (iii) a charged toner polarity reversing device mounted against each module of the second plurality of toner image producing electrostatographic modules for reversing a polarity of toner particles forming the second set of toner images from the first polarity to a second an opposite polarity; and (iv) a transfer device for transferring the second set of toner images having the second polarity onto a second side of the web of recording media.

18 Claims, 6 Drawing Sheets

COMMON POLARITY TONER DUPLEXING ELECTROSTATOGRAPHIC REPRODUCTION MACHINE

BACKGROUND OF THE DISCLOSURE

This disclosure relates generally to electrostatographic reproduction systems, and more specifically, it is directed to a common polarity toner image duplexing electrostatographic reproduction machine.

The basic process of monocolor electrostatographic reproduction (e.g. black image placed on a white background) comprises exposing a charged photoconductive member. The irradiated areas of the photoconductive surface are discharged to record thereon an electrostatic latent image corresponding to the original document.

In electrostatographic reproduction includes cases where an electrostatic charge is deposited image-wise on a dielectric photoconductive member as well as electrophotographic reproduction in which an overall electrostatically charged photoconductive dielectric photoconductive member is image-wise exposed to conductivity increasing radiation producing thereby a "direct" or "reversal" toner-developable charge pattern on the photoconductive member. "Direct" development involves positive-positive development between charge and toner, and is particularly useful for reproducing pictures and text. "Reversal" development is of interest when from a negative original a positive reproduction has to be made or vice-versa, or when the exposure derives from an image in digital electrical signal form, wherein the electrical signals modulate a laser beam or the light output of light-emitting diodes (LEDs). It is advantageous with respect to a reduced load of the electric signal modulated light source (laser or LEDs) to record graphic information (e.g. printed text) in such a way that the light information corresponds with the graphic characters so that by "reversal" development in the exposed area of a photoconductive recording layer, toner can be deposited to produce a positive reproduction of an electronic original.

A development system, thereupon, moves a developer mix of carrier granules and toner particles into contact with the photoconductive surface. The toner particles are attracted electrostatically from the carrier granules to the latent image forming a toner powder image thereon. Thereafter, the toner powder image is transferred to a sheet of support material. Following the toner image transfer to the sheet of support material, the support material sheet advances to a fuser which permanently affixes the toner powder image thereto.

Essentially, multicolor electrostatographic copying and reproduction (e.g. several colors placed on a white background) repeats the process of monocolor reproduction by repeating a plurality of cycles, each cycle being for a different color. Development stations for each of the different colors apply a specific color toner complimentary in color to the color of a filter utilized to produce the irradiated areas of the photoconductive member. The different color toners are generally, cyan, magenta, and yellow (and sometimes black if a true black is desired), which in one combination or another can be used to generate the full spectrum of visible colors.

Through the application of the different colored toners at the respective stations, a plurality of color toner powder images are formed for transfer directly to a sheet of support material or to an intermediate belt for subsequent transfer to a sheet of support material. In either case the images are transferred in superimposed registration with one another. After a plurality of different color toner powder images have been transferred to the sheet of support material in superimposed registration with one another, the multicolor toner powder image is permanently affixed thereto.

In recent years, there have been demands for machines, for example duplex machines, providing high productivity, high quality images. Such a machine is disclosed for example in EP0629924 (assigned to Xeikon) and comprises an electrostatographic single-pass duplexing multiple station multi-color reproduction machine. In it a toner image is formed on a photoconductive member of an imaging modules and is then transferred to a paper receiving sheet such as a continuous web whereon the toner image is treated with a pair of opposed corona generating corotrons or "duets" and is then fused. Thereafter, the web is usually then cut into sheets containing the desired image frames.

The opposed corona generating corotrons or "duet" arrangement in such a machine is disadvantageous in that it requires use of many corotrons. For example, two corotrons (one on top of the paper and another on the bottom of the paper opposing the top corotron) are needed as a duet for every imaging modules. In a seven imaging modules duplexing machine for example, this translates to 14 corotrons for the duet function.

Duets are used in the Xeikon configuration mainly to "correct" the toner charge prior to each color imaging module. In practice "correction" means charging "the toner on the side of the paper that will face the next imaging module's drum" toward the same polarity that the toner has on the next imaging drum. The alternative would be a more expensive use of different polarity toners.

There is therefore a need for an economical common polarity toner duplexing electrostatographic reproduction machine.

In accordance with the present disclosure, there is provided a common polarity duplexing electrostatographic reproduction machine that includes (i) a first plurality of toner image producing electrostatographic modules that each include a first image forming surface, image forming devices, and charged toner particles having a first polarity, (ii) a second plurality of toner image producing electrostatographic modules that each have a second image forming surface, image forming devices, including charged toner particles having a polarity common with the first polarity, (iii) a charged toner polarity reversing device mounted against each module of the second plurality of toner image producing electrostatographic modules for reversing a polarity of toner particles forming the second set of toner images from the first polarity to a second an opposite polarity; and (iv) a transfer device for transferring the second set of toner images having the second polarity onto a second side of the web of recording media.

In the detailed description of the disclosure presented below, reference is made to the drawings, in which.

While the present disclosure will be described in connection with a preferred embodiment thereof, it will be understood that it is not intended to limit the disclosure to that embodiment. On the contrary, it is intended to cover all alternatives, modifications, and equivalents as may be included within the spirit and scope of the disclosure as defined by the appended claims.

Figure 1:
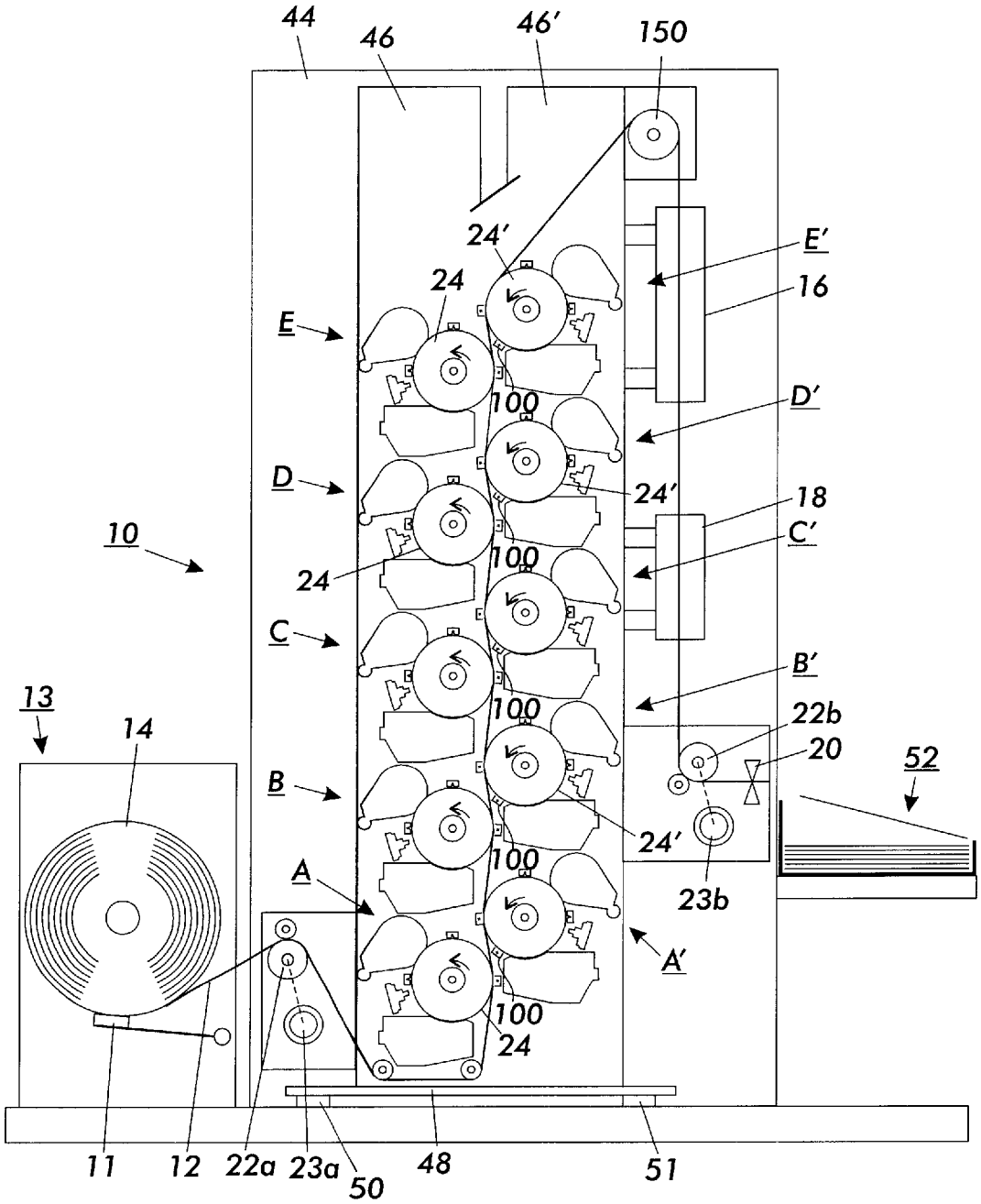
FIG. 1 shows a section of a common polarity toner image duplexing electrostatographic reproduction machine including plural imaging modules according to the present disclosure.

Referring now to FIG. 1, there is illustrated a common polarity duplexing electrostatographic reproduction machine 10 in accordance with the present disclosure. As shown, the electrostatographic reproduction machine 10 includes a supply station 13 in which a roll 14 of web material 12 is housed, for example, in sufficient quantity to print, say, up to 5,000 images. The web 12 is conveyed into a tower-like printer housing 44 in which support columns 46, 46' are provided, housing a number of similar imaging modules A to D, A' to D'. In addition, each column includes a further module E, E' in order to optionally enable printing an additional color, for example a specially customized color, for example white. The imaging modules A to E, A' to E' are mounted in a substantially vertical configuration resulting in a reduced footprint of the machine 10, and additionally making servicing easier. The columns 46, 46' may be mounted against vibrations by means of a platform 48 resting on springs 50, 51.

Thus, as shown in FIG. 1, each column 46, 46' of the electrostatographic reproduction machine 10 comprises 4 imaging modules A, B, C, D, E as well as A', B', C', D' and E' which are arranged for printing for example yellow, magenta, cyan, black and an optional color toner images respectively on the respective sides 12L, 12R of the web 12. The imaging modules (i.e., image-producing stations) A, B, C, D, E and A', B', C', D', E' are arranged in a substantially vertical configuration, although it is of course possible to arrange the stations in a horizontal or other configuration. A web of paper 12 unwound from a supply roller 14 is conveyed in an upwards direction past the imaging modules in turn.

After leaving the final imaging modules E, E', the composite duplex image on the web 12 is fixed or fused by means of image-fixing stations 16 and 18, and are then fed to a cutting station 20 (schematically represented) and to a cut web/sheet stacker 52 if desired. As discussed above, the web 12 is conveyed through the machine 10 by the two drive rollers 22*a*, 22*b* which are shown one positioned between the supply station 13 and the first imaging modules A, A', and the second positioned between the image-fixing stations 16, 18 and the cutting station 20. The drive rollers 22*a*, 22*b* are driven by controllable motors, 23*a*, 23*b*.

As shown, after passing the first imaging module A, the web 12 passes successively to imaging modules B, C D and E on the one side where images in other colors are transferred to the web, and modules A', B', C', D' and E' on the other side where images in various colors are formed and transferred to the web. The moving web 12 is in face-to-face contact with the drum surfaces 26, 26' over a desired wrapping angle at each module as determined by the position of guide rollers 36. After passing the last imaging modules E and E', the web 12 then passes over a roller 150 and through an image-fixing station 16, an optional cooling zone 18, and thence to a cutting station 20 where the web 12 is cut into sheets for discharge to an output tray 52.

The imaging modules A, B, C, D, E and A', B', C', D', E' are each identical except for the inclusion of a pre-transfer toner polarity reversing corotron device 100 (in accordance with the present disclosure, and to be described in detail below) on each of the imaging modules A', B', C', D', E', for example. Detailed description of one of the modules, for example the module A', will thus suffice as a description of each of the other modules, given proper notification of the exception mentioned above.

Figure 2:
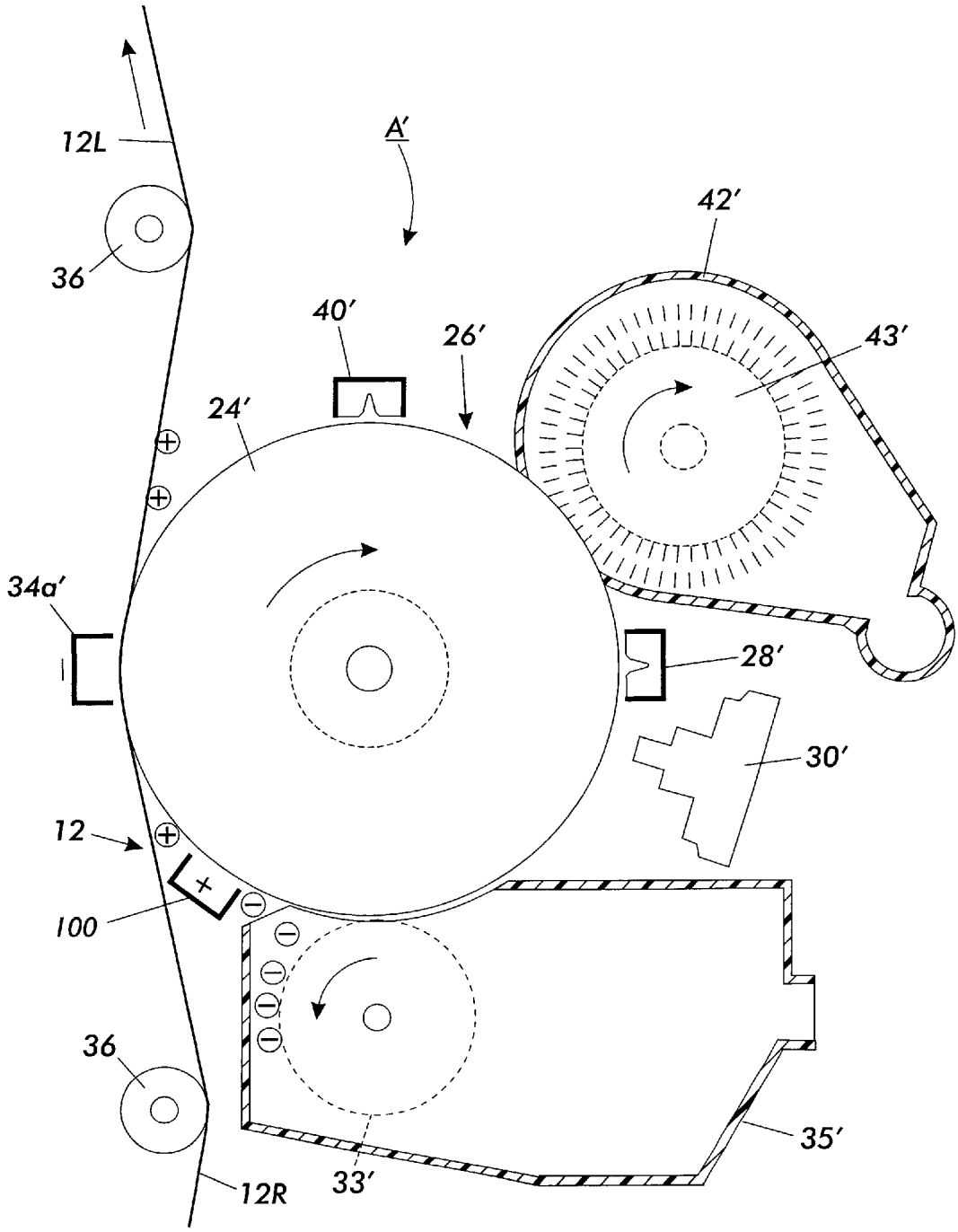
FIG. 2 represents a diagrammatic cross-sectional view of an imaging module of the imaging modules of the machine of FIG. 1.
Figure 3:
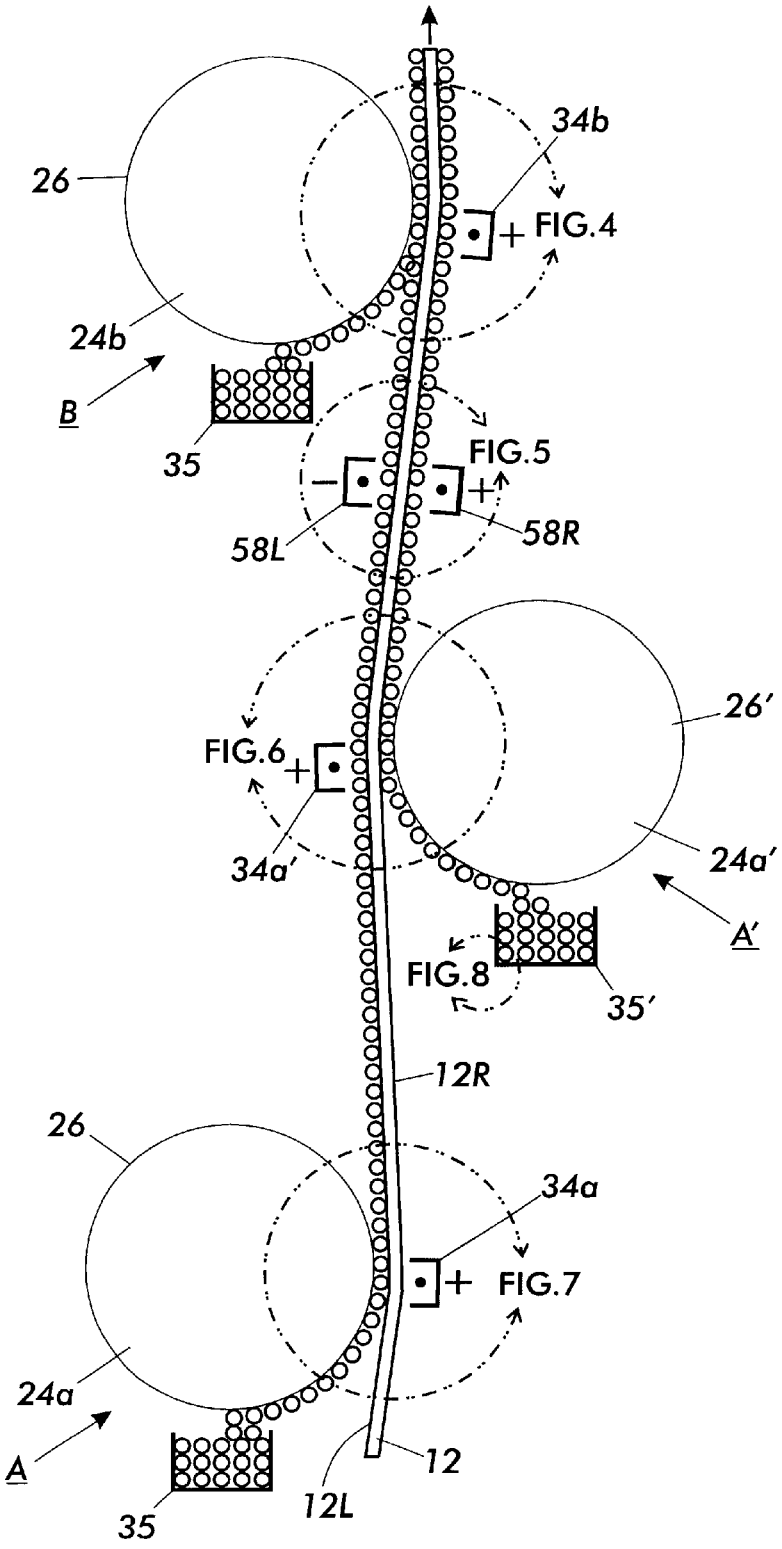
FIG. 3 (PRIOR ART)
FIGS. 3–8 are each an enlarged schematic of part of a conventional (prior art) toner image duplexing machine including a use of "duets" or of a pair of opposed corotron devices.

Thus, as shown in FIG. 2, A' (and hence the rest of the other modules) comprises a cylindrical drum 24' having a photoconductive outer surface 26'. circumferencially arranged around the drum 24' there is a main corotron or scorotron charging device 28' capable of uniformly charging the drum surface 26' to a potential having a desired level and polarity. There is also arranged an exposure station 30' which may, for example, be in the form of a scanning laser beam or an LED array, which will image-wise and line-wise expose the photoconductive drum surface 26' causing the charge on the latter to be selectively discharged, thus leaving an image-wise distribution of electric charge or "latent image" on the drum surface 26'.

This so-called "latent image" is then rendered visible by a developing station 32', which by means known in the art will bring a charged developer into contact with the drum surface 26'. The developing station 32' for example may include a developer drum 33' which is adjustably mounted thus enabling it to be moved radially towards or away from the drum 24'. According to one embodiment, the developer contains (i) charged toner particles, for example negatively charged toner particles as shown, containing a mixture of a resin, a dye or pigment of the appropriate color and normally a charge-controlling compound giving triboelectric charge to the toner, and (ii) carrier particles charging the toner particles by frictional contact therewith.

The carrier particles may be made of a magnetizable material, such as iron or iron oxide. In a typical construction of a developer station 32', the developer drum 33' contains magnets carried within a rotating sleeve causing the mixture of toner and magnetizable material to rotate therewith, to contact the surface 26' of the drum 24' in a brush-like manner. Toner particles charged triboelectrically to an appropriate level and polarity (e.g. negative polarity) are attracted to the "latent image" areas on the drum surface 26' by the electric field between these areas so that the latent image becomes visible. All reference numerals, e.g. 24' used in reference to the modules A', B', C', D', and E', are the equivalent for example of 24 for the modules A, B, C, D, and E.

In accordance with the present disclosure, after the toner image is developed or made visible as such, each of the imaging modules only on one side of the web 12 (for example A', B', C', D', E' on the side 12R) includes a toner polarity reversing corotron device 100 located on the photoconductive drum 24' thereof, and upstream of the point of toner image transfer to the web 12, for reversing the polarity (e.g. from negative to positive as shown) of the toner image on the surface 26'. The imaging modules only on one side of the web 12 could equally have been the modules A, B, C, D and E. In either case, pre-transfer toner polarity reversal as such advantageously enables the use of the same or a common polarity developer (e.g. negative polarity as shown) and toner in all the imaging modules for both simplex (using just A, B, C, D and E or A', B', C', D' and E'), and duplex using (A, B, C, D and E as well as A', B', C', D' and E') operations of the machine 10. Pre-transfer toner polarity reversal as such also reduces the number of corotron or corona devices needed in machines of the present disclosure as compared to conventional machines using the "duet" arrangements.

Thus, on the one hand (i.e. for each of modules A', B', C', D' and E' on the side 12R of the web 12 as an example), after toner image development with negative or common polarity charged toner, the polarity of the toner image adhering to the drum surface 26' is reversed by a positive charge generating corotron device 100. After such reversal, the toner image (now positive) is then transferred as a positive toner image to the side 12R of the moving web 12 with the aid of a negative transfer corona device 34*a*'. The negative charge sprayed by the transfer corona device 34*a*', being on the opposite side of the web 12 relative to the drum 24' of the module A', and having a polarity (negative) opposite in sign to that (positive) of the charge now on the toner image, operates electrostatically to attract the toner image away from the drum surface 26' and onto the side 12R of the web 12. The transfer corona device 34*a*' serves to generate a strong adherent force between the web 12 and the drum surface 26' in addition to urging the toner particles into firm contact with the side 12R of the web 12.

After image transfer from the surface 26' to the side 12R of web 12 as shown, the drum surface 26' is pre-charged to a suitable level by a pre-charging corotron or scorotron device 40' thus making the final charging by the corona 28' easier. Following such pre-charging, any residual toner remaining on the drum surface 26' is then easily removed by a cleaning device 42'. The cleaning unit 42' for example may include an adjustably mounted cleaning brush 43', the position of which can be adjusted towards or away from the drum surface 26' to ensure optimum cleaning. After such cleaning, the drum surface is ready for another recording cycle starting with charging by the corona device 28'.

Figure 4:
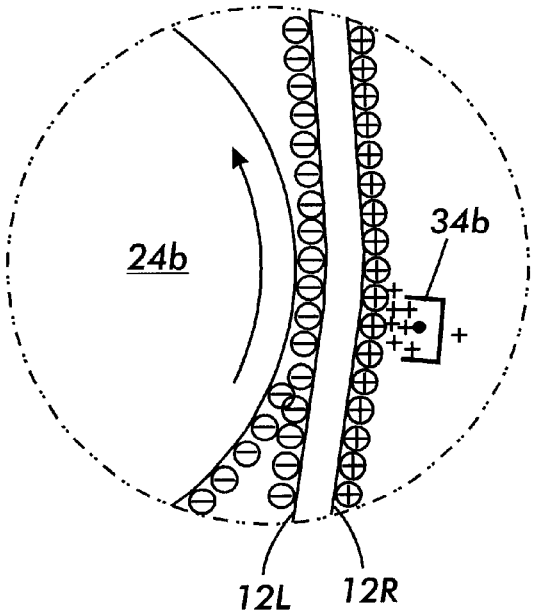
FIG. 4 (PRIOR ART)

On the other hand, for each of modules A, B, C, D and E on the side 12L of the web 12, (as also shown in FIG. 4), after toner image development with negative or the common polarity toner, such toner image adhering to the drum surface 26 (of each of modules A, B, C, D and E), is transferred as a negative toner image (without reversal) to the moving web 12 with the aid of a positive transfer corona device 34. The positive charge sprayed by the transfer corona device 34, being on the opposite side of the web 12 relative to the drum 24, and having a polarity (positive) opposite in sign to that (negative) of the charge on the toner image, operates electrostatically to attract the toner image away from the drum surface 26 and onto the side 12L of the web 12. The transfer corona device 34 serves to generate a strong adherent force between the web 12 and the drum surface 26, in addition to urging the toner particles into firm contact with the side 12L of the web 12.

Referring to FIG. 2 and applying it to the modules A, B, C, D and E, after image transfer from the surface 26 to the side 12L of web 12 as shown, the drum surface 26 is pre-charged to a suitable level by a pre-charging corotron or scorotron device 40 thus making the final charging by the corona 28 easier. Following such pre-charging, any residual toner remaining on the drum surface 26 is then easily removed by a cleaning device 42. The cleaning unit 42 for example may include an adjustably mounted cleaning brush 43, the position of which can be adjusted towards or away from the drum surface 26 to ensure optimum cleaning. After such cleaning, the drum surface is ready for another recording cycle starting with charging by the corona device 28.

Figure 5:
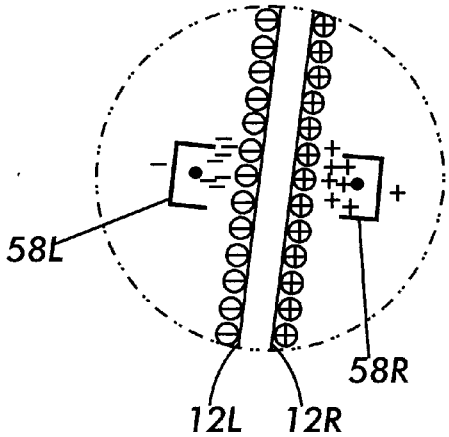
FIG. 5 (PRIOR ART)
Figure 6:
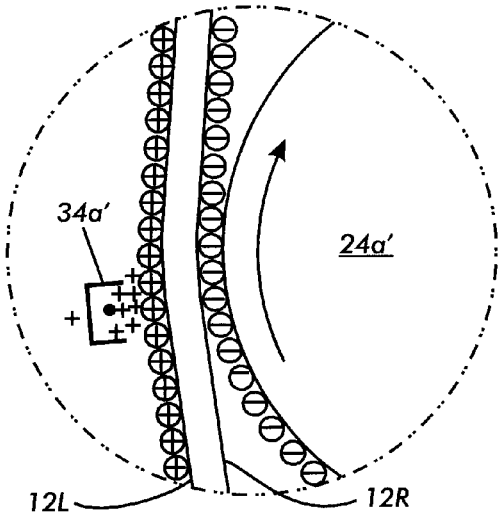
FIG. 6 (PRIOR ART)
Figure 7:
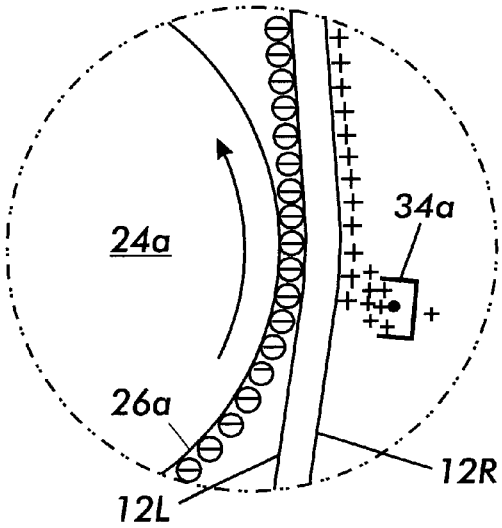
FIG. 7 (PRIOR ART)
Figure 8:
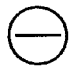
FIG. 8 (PRIOR ART)

FIGS. 3–8 are each an illustration of part of a conventional "duet arrangement type duplexing machine showing use of a duet 58L and 58R after each set of opposite modules, for example, A and A'. As shown in FIGS. 2 and 8, at each of the modules, for example A, A' and B, a developer unit 35, 35' deposits negative toner (for example) on the surface 26, 26' of the drum 24*a*, 24*b*, 24*a*'. As shown in FIGS. 2 and 7, at the module A, a positive corona device 34*a* assists in transferring the negative toner image from the surface 26 onto the side 12L of the web 12, but also changes the toner image on side 12L to positive. At the next module A' as shown in FIGS. 2 and 6, a positive corona device 34*a*' also assists in transferring the negative toner image from the surface 26' onto the side 12R of the web 12 but also changes the toner image on side 12L to positive. Importantly as shown In FIGS. 2 and 5, in order for the positive toner image now on the side 12L not to transfer back onto a negative drum surface 26, this arrangement employs a negative corona device 58L for reversing the polarity of the toner image on the side 12L from positive back to negative. For reasons to be explained below, it is also necessary to use the second and opposed corona device 58R. At the next module B, as shown in FIGS. 2 and 4, a negative toner image can then be formed on the surface 26 of drum 24*b*, and transferred to side 12L with the help of a positive corona device 34*b*.

Thus, in advance of the third image-producing module B, and also between each subsequent pair of opposite image-producing modules (not shown), an opposed pair of corona discharge devices 58L and 58R are positioned one on each side of the web 12. The polarity of the corona discharge devices 58L and 58R are chosen to reverse the charge carried on the toner particles carried on the adjacent face 12R and 12L respectively of the web 12. As shown, between the modules A' and B, the positively charged toner particles on the face 12L of the web 12 are reversed to carry a negative charge as they pass the negative corona device 58L, while the negatively charged toner particles on the face 12R of the web 12 are reversed to carry a positive charge as they pass the negative corona device 58R. As can be seen the toner particles of the first color on the face 12L are now negatively charged as they reach the negatively charged drum 24*b* and they are therefore repelled by the charge on the drum preventing their removal from the web, assisted by the positive charges from the transfer corona 34*b*. The web therefore continues to the next module in the electrostatographic reproduction machine carrying toner particles of both the first and second colors on the face 12L in the desired amounts according to the image to be produced.

The "Duets" (58L, 58R) are needed in order to avoid severe toner image retransfer that would otherwise occur when the same polarity toner is to be transferred for image on image simplex and duplex operation of such a machine. Thus in order to avoid such severe retransfer without resorting to using different polarity toners in the simplex and duplex development systems, "duets" as such have to be employed.

Thus, "duets" are used in conventional such machines mainly for "correcting" the toner charge prior to each subsequent color imaging module. In practice "correcting" means charging "the toner on the side of the web that will face the next imaging module's drum" toward the same polarity that the toner has on that next imaging drum. For example, with negative polarity toner used in the imaging drum modules, the duet is arranged to spray negative charge toward the web on the side of the web that will face the next imaging drum. Thus a "loner charge correction" is needed because, in prior imaging module transfer zones, the polarity of the toner on that side of the web will get reversed compared to the polarity of toner on the drum (due to the charge deposited toward the web by the transfer corotron at the previous transfer station and also by the charge deposited by the previous duet. If the toner charge on that side of the web is not "corrected" to be the same polarity as the toner on the next imaging module drum, then the toner on that side of the web will transfer back to such next drum when the transfer corotron is adjusted to try to make the right signed toner on the drum transfer to the web.

Unfortunately however, this necessary toner charge "correction" is done on the web prior to the transfer zone while the web is relatively far from any reference grounded conductors. As a negative consequence, the capacitance between the web and nearby conductors thus is very, very small. As such, a "duet" must be used because use of a single corona device to attempt correct the toner charge on the web (even in very small amounts of charge deposited onto the web) will cause the potential on the web to head toward "infinity" (very, very high). Such very high potentials will in effect operate instead to prevent significant charging by such a single corotron device in such an arrangement.

Thus, "duets" are necessary because the corona device (e.g. 58L) used to try to correct the toner charge on one side (12L) of the web 12 "in free space" must have an additional corona device (58R) on the opposite side (12R) of the web for depositing a reversal polarity charge on such opposite side. This thus prevents the very, very high potentials and thereby allows sufficient charge deposition for correcting the toner charge. In a qualitative sense, the additional "duet" corotron on the opposite side of the web acts like a "pseudo ground" for the "toner charge correcting corotron". At any rate, a penalty is that two corotrons instead of one are needed for the simple function.

Figure 9:
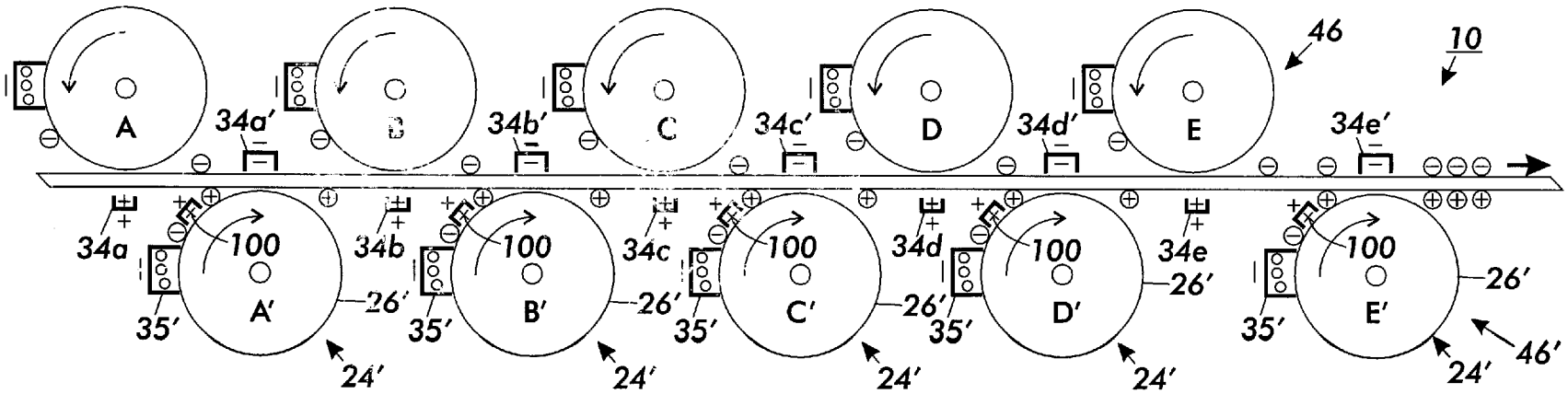
FIG. 9 is a schematic of the machine of FIG. 1 showing the pre-transfer transfer toner polarity reversing devices of the present disclosure.

Referring now to FIGS. 1 and 9, on the one hand, each of the modules A, B, C, D, and E on the one side 12L of the web 12 has a drum 24 with surface 26 and negative polarity developer development station 35 for forming negative polarity toner images on the surface 26. Each thus can form a negative toner image that is transferred as such onto the side 12L of web 12 with the help of a positive transfer-assist corona device 34*a*, 34*b*, 34*c*, 34*d*, and 34*e*. On the other hand, each of the modules A', B', C', D', and E' on the other side 12R of the web 12 has a drum 24' with surface 26' and negative polarity developer development station 35' for forming negative polarity toner images on the surface 26'. Each module thus can form a negative toner image on the surface 26'. In addition, each such module A', B', C', D', and E' includes a toner polarity reversing corotron or corona device 100 for reversing the polarity of the formed toner image from negative to positive. In accordance with the present disclosure, the polarity of the toner image on each of the drums 24' is thus reversed from negative to positive before such toner image is then transferred as positive onto the side 12R of web 12 with the help of a negative transfer-assist corona device 34*a*', 34*b*', 34*c*', 34*d*', and 34*e*' as shown.

The corotron device 100 is thus used at a pre-transfer location for conditioning the toner image on the photoconductor or drum 24' on one side (12R) of the web by reversing the polarity of the toner right on the drum 24'. This thus enables the use of the same or common polarity developer and toner packages on both sides of the machine for simplex and duplex operations. Use of the corotron device 100 as such also reduces the number of such corona devices that are needed for such duplexing operations as compared to the conventional "duet approach.

There are significant advantages from using common polarity toners as above, and then reversing such polarity on the drum 24, 24' on one side (for example 12R) of the web, before transfer of the reversed polarity image to the web 12. For one thing, in accordance with the present disclosure, only 5 corona devices 100 (as opposed to 10 in a duet arrangement) would be needed. Such a reduction in the number of corona devices of course saves cost (less parts, power supplies, etc.), improves reliability (less parts to go wrong) and reduces service cost and/or customer annoyance (reduced number of corotron cleaning actions.

Note that if common polarity toners are not used in the immediate duplex configuration, then a different polarity and developer formulation for each of Y,M,C,K color toners would have to be used on one side of the web versus the other side of the web 12. This is undesirable because ordinarily, it is frequently a major challenge to develop one good set of color developer formulations for a product. Needing to double the set of compatible color developer formulations Y,M,C,K for a machine. Developing more than one set of course would obviously be a major challenge because in order to have acceptable image quality, the toners in both sets must be "identical" relative to colorants, for example.

To maintain commonality in the imaging systems used for both sides of the print, the two different toner formulations would need to have compatible fixing, transfer, cleaning, and development, performance for examples. It is generally unlikely that any machine developers would even consider taking on such challenges. Even if different formulations for the two sides were achieved, there are other disadvantages. For example, now the Y,M,C,K color developers for one side of the print must be packaged stored separately, for example, from the other Y,M,C,K color developers of the other side, and a system must be in place to make sure "one side's developer does not get put into the wrong side imaging system". As can be seen, there has been provided a common polarity duplexing electrostatographic reproduction machine that includes (i) a first plurality of toner image producing electrostatographic modules that each include a first image forming surface, image forming devices, and charged toner particles having a first polarity, (ii) a second plurality of toner image producing electrostatographic modules that each have a second image forming surface, image forming devices, including charged toner particles having a polarity common with the first polarity, (iii) a charged toner polarity reversing device mounted against each module of the second plurality of toner image producing electrostatographic modules for reversing a polarity of toner particles forming the second set of toner images from the first polarity to a second an opposite polarity; and (iv) a transfer device for transferring the second set of toner images having the second polarity onto a second side of the web of recording media.

While the embodiment of the present disclosure disclosed herein is preferred, it will be appreciated from this teaching that various alternative, modifications, variations or improvements therein may be made by those skilled in the art, which are intended to be encompassed by the following claims:

What is claimed is:

1. A common polarity duplexing electrostatographic reproduction machine comprising:

a. a machine frame:

b. recording media supply assembly mounted to said frame and including a media roll and means for supplying a web of recording media from said media roll;

c. a first plurality of toner image producing electrostatographic modules mounted to said frame; each module of said first plurality of toner image producing electrostatographic modules including a first image forming surface, image forming devices, and charged toner particles having a first polarity, for producing a first set of toner images on said first image forming surface;

d. a first means for transferring said first set of toner images onto a first side of said web of recording media;

e. a second plurality of toner image producing electrostatographic modules mounted to said frame; each module of said second plurality of toner image producing electrostatographic modules having a second image forming surface, image forming devices, including charged toner particles having a polarity common with said first polarity, for producing a second set of toner images on said second imaging surface;

f. a charged toner polarity reversing device mounted against said each module of said second plurality of toner image producing electrostatographic modules for reversing a polarity of toner particles forming said second set of toner images from said first polarity to a second and opposite polarity; and g. second means for transferring said second set of toner images having said second polarity onto a second side of said web of recording media.

2. The common polarity duplexing electrostatographic reproduction machine of claim 1, wherein said first plurality of toner image producing electrostatographic modules comprises at least two modules for producing highlight color toner images on said first side of said web of recording media.

3. The common polarity duplexing electrostatographic reproduction machine of claim 1, wherein said second plurality of toner image producing electrostatographic modules comprises at least two modules for producing highlight color toner images on said second side of said web of recording media.

4. The common polarity duplexing electrostatographic reproduction machine of claim 1, wherein said first plurality of toner image producing electrostatographic modules comprises at least four modules for producing full color toner images on said first side of said web of recording media.

5. The common polarity duplexing electrostatographic reproduction machine of claim 1, wherein said second plurality of toner image producing electrostatographic modules comprises at least four modules for producing full color toner images on said second side of said web of recording media.

6. The common polarity duplexing electrostatographic reproduction machine of claim 1, wherein said first polarity of said charged toner particles is negative.

7. The common polarity duplexing electrostatographic reproduction machine of claim 1, wherein said charged toner polarity reversing device mounted against said each module of said second plurality of toner image producing electrostatographic modules reverses said polarity of said toner particles on said second image forming surface.

8. The common polarity duplexing electrostatographic reproduction machine of claim 6, wherein said second and opposite polarity is positive.

9. The common polarity duplexing electrostatographic reproduction machine of claim 8, wherein said second means for transferring said second set of toner images having said second polarity onto said second side of said web of recording media includes a negative charge producing corona device.

10. A common polarity duplexing electrostatographic reproduction machine comprising:

a. first plural toner image producing electrostatographic modules each including a first image forming surface, image forming devices, and charged toner particles having a first polarity, for forming a first set of toner images having said first polarity;

b. second plural toner image producing electrostatographic modules each having a second image forming surface, image forming devices, including charged toner particles having a polarity common with said first polarity for forming a second set of toner images having on said second image forming surface, c. a charged toner polarity reversing device mounted against each module of said second plural toner image producing electrostatographic modules for reversing a polarity of toner particles forming said second set of toner images from said first polarity to a second and opposite polarity; and d. a transfer device for transferring said second set of toner images having said second polarity onto a second side of the web of recording media.

11. The common polarity duplexing electrostatographic reproduction machine of claim 10, wherein said first polarity of said charged toner particles is negative.

12. The common polarity duplexing electrostatographic reproduction machine of claim 10, wherein said charged toner polarity reversing device comprises a charge producing corotron.

13. The common polarity duplexing electrostatographic reproduction machine of claim 11, wherein said second and opposite polarity is positive.

14. The common polarity duplexing electrostatographic reproduction machine of claim 13, wherein said second transfer device for transferring said second set of toner images having said second polarity onto said second side of said web of recording media comprises a negative charge producing corona device.

15. The common polarity duplexing electrostatographic reproduction machine of claim 13, including means for transferring said first set of toner images having said first polarity onto said first side of the web of recording media.

16. The common polarity duplexing electrostatographic reproduction machine of claim 13, wherein said imaging devices include an endless rotatable means in the form of a drum.

17. The common polarity duplexing electrostatographic reproduction machine of claim 13, including a duplex toner image fusing apparatus located downstream of said image producing modules.

18. The common polarity duplexing electrostatographic reproduction machine of claim 14, including cutting means for cutting the web into desired size image sheets.

* * * * *